US009441491B2

(12) United States Patent
Kim et al.

(10) Patent No.: US 9,441,491 B2
(45) Date of Patent: Sep. 13, 2016

(54) SHROUD IMPELLER OF CENTRIFUGAL COMPRESSOR AND METHOD OF MANUFACTURING THE SAME

(71) Applicant: DOOSAN HEAVY INDUSTRIES & CONSTRUCTION CO., LTD., Gyeongsangnam-do (KR)

(72) Inventors: Kyung Kook Kim, Daejeon (KR); Sang Eon Lee, Daejeon (KR)

(73) Assignee: DOOSAN HEAVY INDUSTRIES & CONSTRUCTION CO., LTD., Changwon-Si (KR)

( * ) Notice: Subject to any disclaimer, the term of this patent is extended or adjusted under 35 U.S.C. 154(b) by 583 days.

(21) Appl. No.: 13/925,298

(22) Filed: Jun. 24, 2013

(65) Prior Publication Data

US 2014/0308132 A1 Oct. 16, 2014

(30) Foreign Application Priority Data

Apr. 12, 2013 (KR) ..... 10-2013-0040502

(51) Int. Cl.

| | |
|---|---|
| ***F01D 5/22*** | (2006.01) |
| ***F04D 29/28*** | (2006.01) |
| ***F04D 29/02*** | (2006.01) |
| ***F04D 29/62*** | (2006.01) |

(52) U.S. Cl.

CPC ..... *F01D 5/225* (2013.01); *F04D 29/023* (2013.01); *F04D 29/284* (2013.01); *F04D 29/624* (2013.01); *Y10T 29/49336* (2015.01)

(58) Field of Classification Search

CPC .. F04D 29/023; F04D 29/284; F04D 29/624; F01D 5/225; Y10T 29/49336

See application file for complete search history.

(56) References Cited

U.S. PATENT DOCUMENTS

| | | | | |
|---|---|---|---|---|
| 2,807,871 | A * | 10/1957 | Wagner | B21D 53/78 29/889 |
| 3,225,422 | A * | 12/1965 | Sebok | B21D 53/267 29/463 |
| 3,285,187 | A * | 11/1966 | Anderson, Jr. | F04D 29/2222 29/889.4 |
| 4,752,183 | A * | 6/1988 | Sakurai | F04D 29/042 415/12 |
| 6,146,094 | A * | 11/2000 | Obana | F04D 29/023 415/200 |
| 6,419,450 | B1 * | 7/2002 | Lum | F04D 29/2222 415/131 |
| 6,592,329 | B1 * | 7/2003 | Hirose | F04D 29/023 416/203 |
| 6,929,452 | B1 * | 8/2005 | Pargeter | F04D 29/281 415/912 |
| 7,305,762 | B2 | 12/2007 | Mola | |
| 8,257,043 | B2 * | 9/2012 | Kuroki | F04D 29/282 416/186 R |
| 2011/0318183 | A1 | 12/2011 | Noronha et al. | |
| 2012/0141261 | A1 * | 6/2012 | Giovannetti | F04D 29/023 415/203 |
| 2013/0004316 | A1 * | 1/2013 | Matwey | F01D 5/048 416/198 A |
| 2013/0017067 | A1 * | 1/2013 | Cantelli | B23K 15/006 415/170.1 |
| 2013/0078099 | A1 | 3/2013 | Ahn | |

FOREIGN PATENT DOCUMENTS

| | | | |
|---|---|---|---|
| JP | 08-159088 | A | 6/1996 |
| JP | 2004-36485 | A | 2/2004 |
| JP | 2010-121612 | A | 6/2010 |
| KR | 10-2012-0075187 | A | 7/2012 |
| WO | 2010/128153 | A1 | 11/2010 |

* cited by examiner

*Primary Examiner* — Igor Kershteyn

(74) *Attorney, Agent, or Firm* — Sughrue Mion, PLLC

(57) ABSTRACT

Disclosed are a shroud impeller of a centrifugal compressor and a method of manufacturing the same where the shroud impeller includes a rotary hub connected to a driving shaft, a plurality of blades radially provided about a rotational axis of the rotary hub, and an integral shroud bonded onto top ends of the blades.

16 Claims, 15 Drawing Sheets

SHROUD IMPELLER OF CENTRIFUGAL COMPRESSOR AND METHOD OF MANUFACTURING THE SAME

CROSS-REFERENCE TO RELATED APPLICATION

This application claims priority from Korean Patent Application No. 10-2013-0040502, filed on Apr. 12, 2013, in the Korean Intellectual Property Office, the disclosure of which is incorporated herein by reference.

BACKGROUND

Aspects of the present inventive concept relate to a shroud impeller used for a centrifugal compressor, and more particularly, to a shroud impeller of a centrifugal compressor, which can be simply manufactured with a high processing yield rate, high structural stability, and high size precision, and a method of manufacturing the same. In general, a centrifugal compressor signifies a device for compressing a fluid by converting kinetic energy into pressure energy through a centrifugal force by sucking the fluid in a rotational axis direction of a high-speed rotor or an impeller and circumferentially exhausting the fluid.

The centrifugal compressor has been extensively applied to various industrial fields such as various types of air conditioning facilities and gas turbine systems.

As shown in FIG. 1A, a general centrifugal compressor includes an impeller 10 having a rotary hub 11 connected to a driving shaft 40 and a plurality of blades 12 radially provided about a rotational axis X-X' of the rotary hub 11.

In addition, the centrifugal compressor includes a housing 20 formed with an inlet into which a fluid to be compressed is introduced and an outlet through which the compressed fluid is discharged and provided with an inner surface 21 fixedly adjacent to the blades 12 and a diffuser 30 that reduces a dynamic pressure component of a voltage component increased due to force received from the impeller 10 and increases a static pressure component thereof.

An impeller used for the general centrifugal compressor constructed as described above is classified into an open impeller and a shroud impeller according to the capacity and performance thereof.

That is, as shown in FIG. 1B, an impeller where outer ends of the blades 12 are open may be called an open impeller 10 or an unshrouded impeller having no shrouds. Since the outer ends of the blades 12 are open in the open impeller 10, mechanical processing is possible so that the open impeller 10 can be easily manufactured. In addition, precise profile tolerance may be ensured so that a structure of the open impeller 10 is stable and a manufacturing cost of the open impeller 10 is relatively low.

However, since the outer ends of the blades are open in the open impeller 10, the open impeller 10 has weak strength insufficient for a gas turbine which rotates at a high speed.

Further, the open impeller 10 represents problems in that some of a compressed fluid is leaked through a gap formed between an outer end of the blade and an inner surface of the housing so that flow loss occurs. In addition, the flow loss is significantly increased due to leakage in an inlet A and an outlet B of the housing 20.

In order to solve the above problems of the open impeller, a shroud impeller 10 has been suggested as shown in FIG. 2. The shroud impeller 10 includes a shroud 13 that connects outer ends of a plurality of blades 12 provided in the rotary hub 11 to each other while surrounding the outer ends of the blades 12.

In the shroud impeller 10, a closed fluid path for a fluid to be compressed is formed by adjacent blades 12 and the shroud 13 so that flow loss may be reduced as compared with that of the open impeller, thereby representing higher compression efficiency.

Further, the shroud 13 serves as a reinforcing structure connecting the blades 12 to each other so that the shroud impeller 10 has strength higher than that of the open impeller.

However, in order to form a path of a fluid to be compressed inside the shroud, the shroud impeller has a very complicated three-dimensional structure so that processing is not easy and a manufacturing cost is considerably increased.

Meanwhile, according to the scheme of manufacturing a shroud impeller according to the related art, an impeller including a shroud is manufactured by a casting scheme or after an open impeller is manufactured by a Hot Isostatic Press (HIP) scheme, the open impeller is mechanically processed and a separate shroud is welded thereto.

However, the impeller manufactured through the casting scheme or the HIP scheme may have a weak strength due to a characteristic of a manufacturing method and the impeller is easily deformed or damaged upon pressure variation.

Further, when the separate shroud is welded, the whole shroud is restrictively welded to a plurality of blades so that a welded region may be easily damaged or broken as pressure is applied thereto.

As a related art of the shroud impeller, FIG. 2A shows a method of mechanically processing a monolithic rotor having a disc shape by a cutting tool 50 controlled using a numerical control tool, which is disclosed in U.S. Pat. No. 7,305,762. However, the above patent may not be compatible with a complicated inner fluid path, and there is a limitation in processing due to a shape of the cutting tool.

Further, FIG. 2B shows a method of manufacturing an impeller by bonding an upstream impeller member and a downstream impeller member to each other after the upstream impeller member and the downstream impeller member are separately processed, which is disclosed in Japanese unexamined patent publication No. 2010-121612 (hereinafter, referred to as patent document 1).

In order to solve the above problem, as disclosed in U.S. patent publication No. 2011-0318183 (hereinafter, referred to as patent document 2), a technology of forming an integral shroud in a blade, and forming a partially divided shroud, and bonding the blade to the integral shroud by brazing welding, stick welding, ultrasonic welding, or electron beam welding has been suggested.

However, in the case of patent document 1, an error may occur when bonding a plurality of members which are separately processed so that it is difficult to maintain accurate shapes of a blade and a shroud. In addition, strength of a bonding part is so low that patent document 1 is not suitable for a compressor of a gas turbine which is rotated at a high speed.

In the case of patent document 2, although strength may be improved by divided shrouds bonded to an integral shroud, processing of the divided shroud is complicated and a bonding work is significantly complicated and inconvenient.

Furthermore, if the divided shrouds are not precisely and accurately bonded and thus an error occurs, dangerous situation may be caused when the impeller is used for a gas turbine rotated at a high speed.

SUMMARY

Exemplary embodiments have been made in an effort to solve the above-described problems, and an aspect of the present inventive concept provides a shroud impeller of a centrifugal compressor, which can be simply manufactured, and has a high processing yield rate, high structural stability, and high size precision, and a method of manufacturing the same.

Another aspect of the present inventive concept is to prevent a shroud blade bonded to a bonding shroud from being separated from the bonding shroud.

According to an exemplary embodiment, there is provided a shroud impeller of a centrifugal compressor, the shroud impeller including: a rotary hub connected to a driving shaft; a plurality of blades radially provided about a rotational axis of the rotary hub; and an integral shroud bonded onto top ends of the blades.

The integral shroud may be bonded onto the top ends of the blades in a direction from the rotary hub to outer ends of the blades.

The integral shroud may include: a plurality of bonding shrouds formed on the top ends of the blades, respectively; and a plurality of shroud blades bonded between the bonding shrouds, respectively.

The bonding shrouds may be integrally formed with the top ends of the blades.

The bonding shrouds may be separately prepared and bonded to the top ends of the blades.

The bonding shrouds and the shroud blades may be bonded to each other through a bonding part provided on contact surfaces of the bonding shrouds and the shroud blades to prevent the shroud blades from being separated caused by a centrifugal load and gas pressure.

The bonding part may be prepared in a form of stepped surfaces which are formed corresponding to each other.

The stepped surface of the shroud blade may be placed lower than the stepped surface of the bonding shroud.

The bonding part may be prepared in a form of inclined surfaces which are formed corresponding to each other.

The inclined surfaces may be inclined toward the blades from both ends of the bonding shroud.

The bonding part may include a coupling groove formed at one of the contact surfaces of the bonding shrouds and the shroud blades and a coupling protrusion formed at a remaining one of the contact surfaces of corresponding to the coupling groove and the bonding part is welded after the coupling protrusion is fitted into the coupling groove.

The shroud blade may be divided into a plurality of pieces bonded to each other.

One or a plurality of connection ribs may be connected between the bonding shrouds, and the shroud blades are divided to have shapes corresponding to a region between each connection rib and the bonding shroud and are bonded to each other.

A bonding space part may be formed between an inner end and an outer end of the bonding shroud by a connection rib, and the shroud blade may be formed corresponding to the bonding space part and is bonded.

The bonding shroud, the connection rib, and the shroud blade may be bonded to each other by stepped surfaces.

The bonding shroud, the connection rib, and the shroud blade may be bonded to each other by inclined surfaces.

One or a plurality of connection ribs may be formed in the boding space part, and the shroud blade may be inserted to have a shape corresponding to the bonding space part between the connection ribs.

Further, there is provided a method of manufacturing a shroud impeller of a centrifugal compressor, the method including: preparing a rotary hub connected to a driving shaft and a plurality of blades radially provided about a rotational axis of the rotary hub; and bonding an integral shroud onto top ends of the blades.

The integral shroud may be bonded in a direction from the rotary hub to outer ends of the blades.

The bonding of the integral shroud may include: forming a plurality of bonding shrouds bonded onto the top ends of the blades; and bonding a plurality of shroud blades between the bonding shrouds, respectively, the shroud blades having shapes corresponding to a space between the bonding shrouds.

The bonding shroud may be integrally formed with the blades when the blades are formed.

The bonding shroud may be separately processed and is bonded onto the top ends of the blades.

The shroud blades may be bonded to the bonding shroud by a bonding part which is processed on contact surfaces of the shroud blades and the bonding shroud to prevent the shroud blades from being separated caused by a centrifugal load and gas pressure.

The shroud blade may be divided into one or a plurality of pieces bonded to each other.

The shroud impeller according to the present inventive concept can be simply manufactured with a high processing yield rate, high structural stability, and high size precision so that high compression efficiency can be achieved. Further, the shroud impeller according to the present inventive concept is suitable for high rotation and can represent high compression efficiency by minimizing flow loss.

In addition, the shroud blade bonded to the bonding shroud can be prevented from being separated from the bonding shroud, thereby ensuring high reliability of the shroud impeller.

DETAILED DESCRIPTION OF THE EXEMPLARY EMBODIMENTS

Hereinafter, exemplary embodiments of the present inventive concept will be described in detail with reference to the accompanying drawings, but the present inventive concept will not be limited to the following embodiments.

Figure 1A:
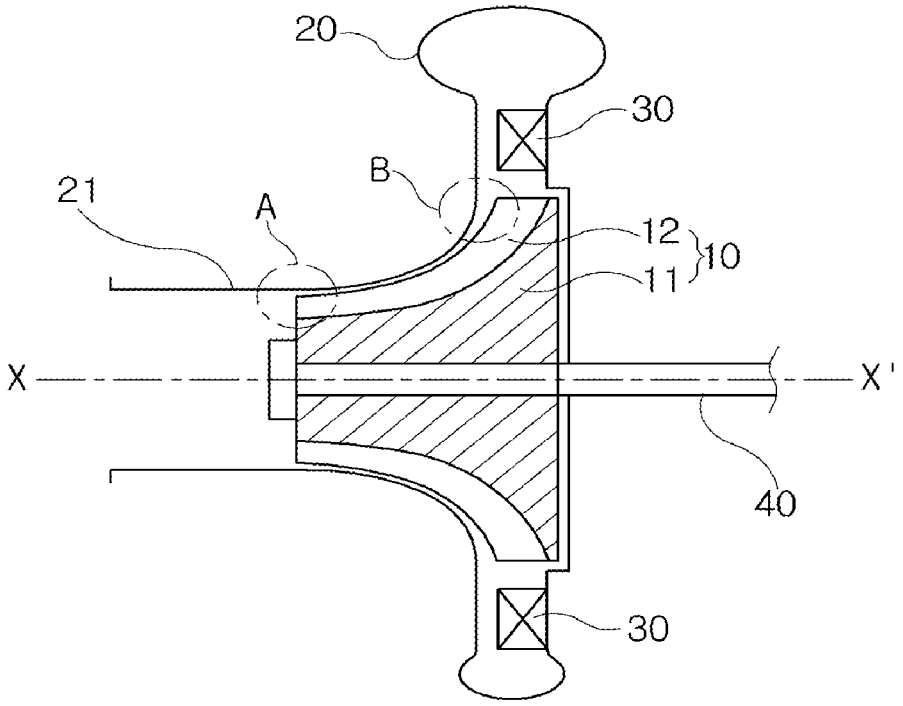
Fig.1A (Related Art)
FIGS. 1A and 1B show a sectional view illustrating a centrifugal compressor including an open impeller and a perspective view illustrating the open impeller according to the related art, respectively.
Figure 1B:
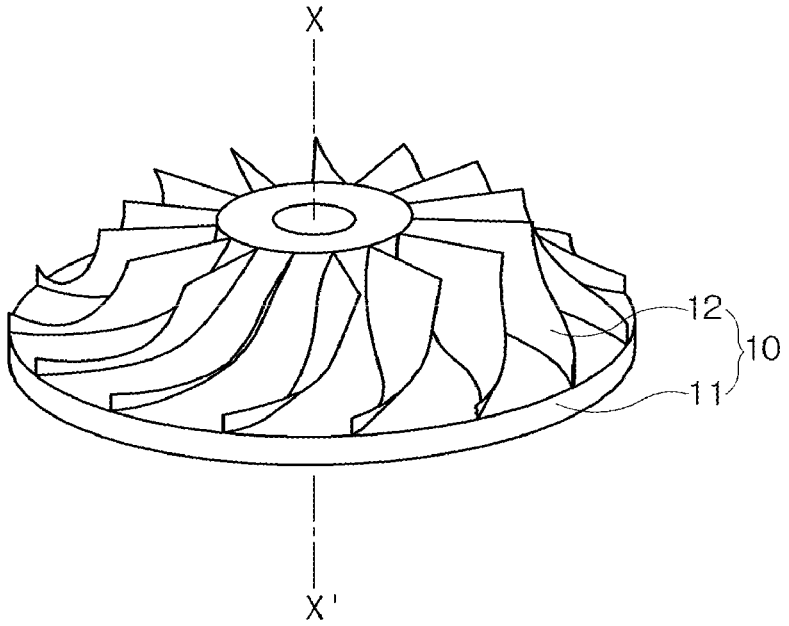
Fig.1B (Related Art)
Figure 2A:
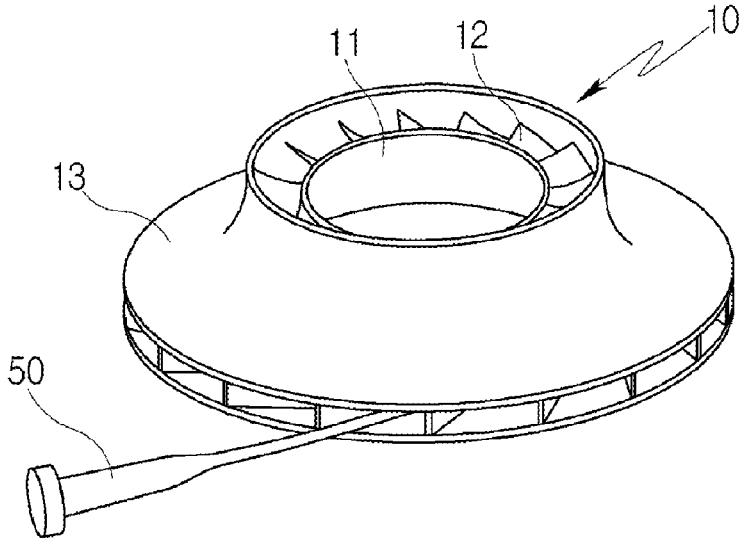
Fig.2A (Related Art)
FIGS. 2A and 2B show a perspective view and a sectional view illustrating a method of processing a shroud impeller according to the related art, respectively.
Figure 2B:
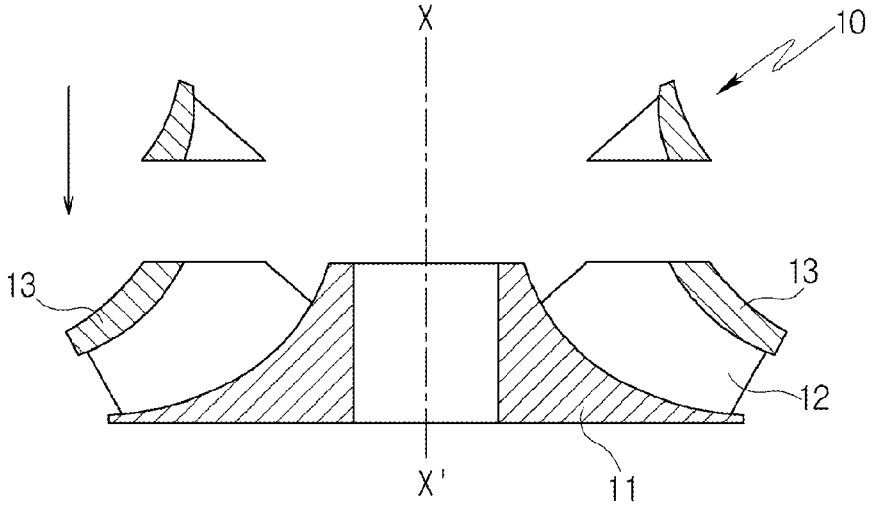
Fig.2B (Related Art)
Figure 3:
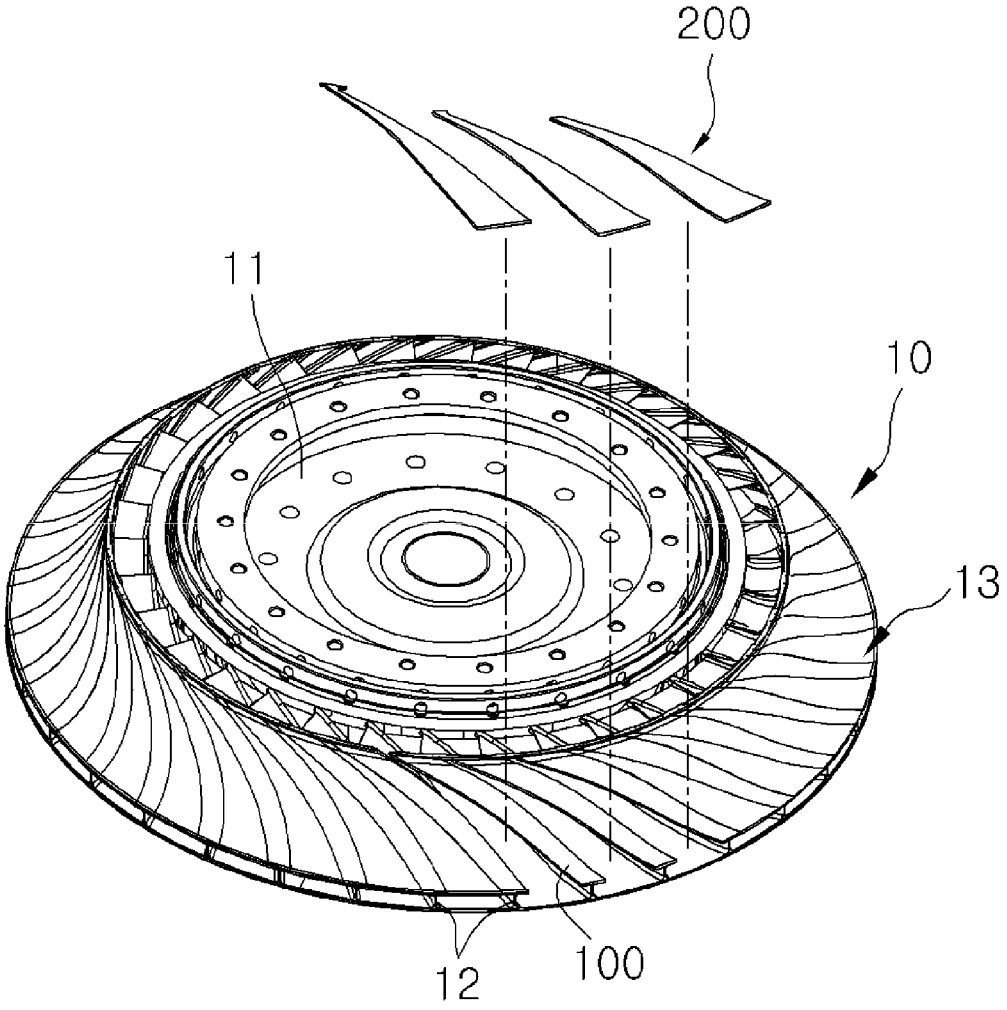
FIG. 3 is an exploded perspective view illustrating a shroud impeller of a centrifugal compressor according to a first embodiment of the present inventive concept.
Figure 4:
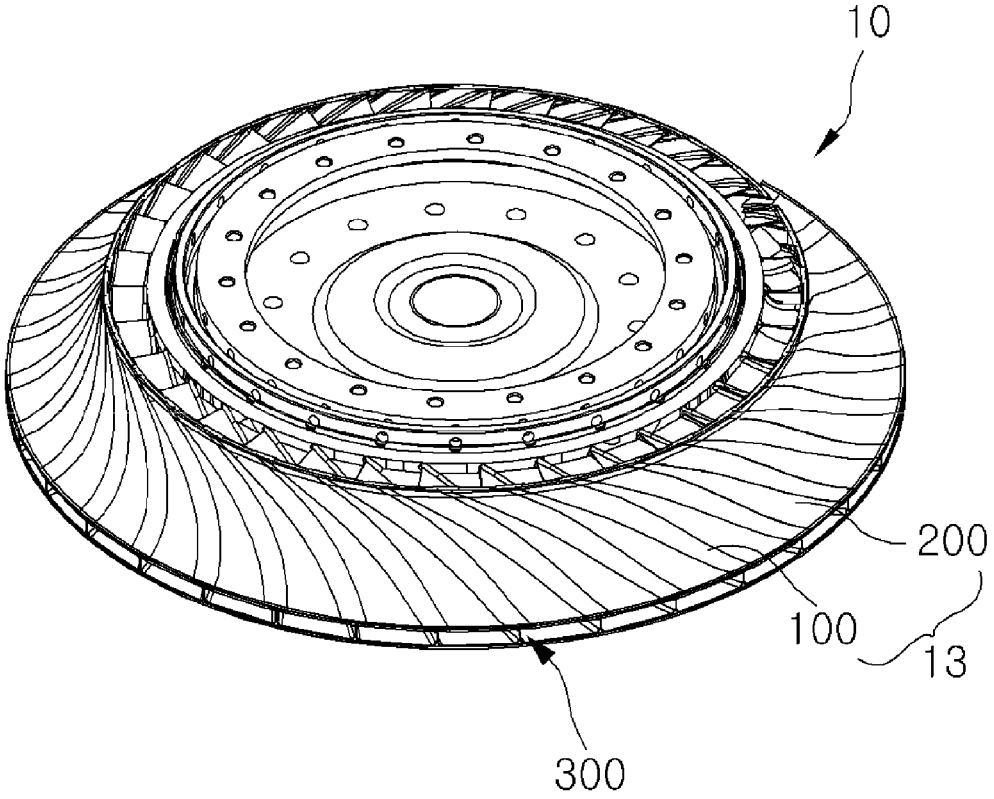
FIG. 4 is an assembled perspective view of FIG. 3.
Figure 5:
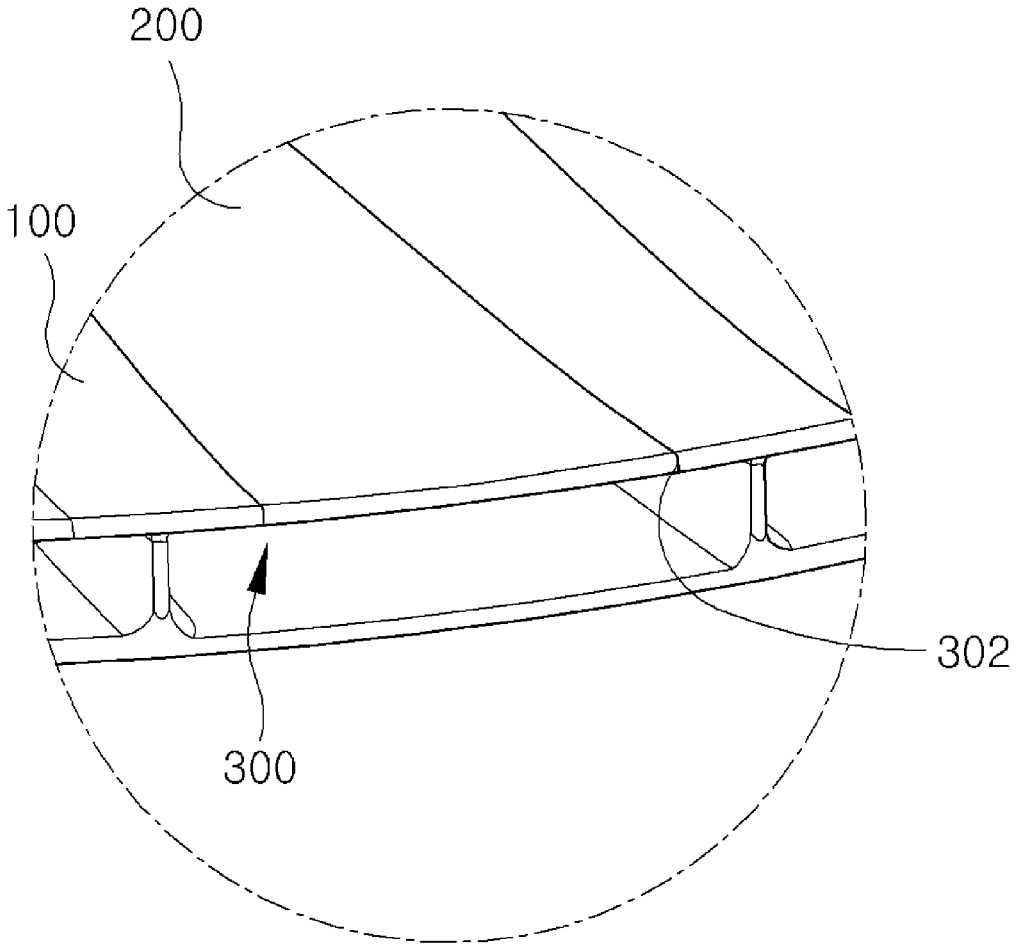
FIG. 5 is an enlarged view of a portion shown in FIG. 4.

FIG. 3 is an exploded perspective view illustrating a shroud impeller of a centrifugal compressor according to a first exemplary embodiment of the present inventive concept, FIG. 4 is an assembled perspective view of FIG. 3, and FIG. 5 is an enlarged view of a portion shown in FIG. 4. The same reference numerals will be used to refer to the same elements.

As shown in drawings, the present inventive concept relates to a shroud impeller adjacent to an inner surface 21 of a housing 20 which is a general centrifugal compressor, and provides a shroud impeller which is simply manufactured with a high processing yield rate, high structural stability, and high size precision, which are advantages of an open impeller.

The shroud impeller 10 according to the present inventive concept includes: a rotary hub 11 connected to a driving shaft (not shown) to receive power from the driving shaft and being rotated based on a rotational axis X-X'; a plurality of blades radially provided at a predetermined interval about a rotational axis X-X' of the rotary hub 11; and an integral shroud 13 bonded onto top ends of the blades 12 by a bonding scheme such as typical welding or brazing so that flow loss of a fluid to be compressed is reduced. In this case, the integral shroud 13 is bonded onto top ends of the blades 12 in a direction from the rotary hub 11 to outer ends of the blades 12.

That is, a closed fluid path in which a fluid to be compressed flows is formed by adjacent blades 12 and the integral shroud 13 so that flow loss may be reduced as compared with an open impeller, thereby ensuring higher compression efficiency.

The integral shroud 13 includes a plurality of bonding shrouds 100 horizontally formed on the blades 12 in perpendicular to the blades 12 by a bonding scheme such as welding or brazing, respectively, and a plurality of shroud blades 200 bonded between the bonding shrouds 100 by a general bonding scheme such as welding or brazing, respectively.

The rotary hub 11 is connected to a driving shaft and receives rotating force from the driving shaft. The rotary hub 11 may be made from a material having high strength suitable for high speed. The rotary hub 11 may be fabricated by heat-treating chromium-molybdenum steel, nickel chromium-molybdenum steel, or stainless steel. A material of the rotary hub 11 is not specially limited if the material can be used to manufacture a general impeller.

Further, the rotary hub 11 may have a conical shape having a sectional area gradually reduced in the direction of the rotational axis X-X'. In this case, a front center portion of the conical shape in the direction of the rotational axis X-X' becomes an inlet 220 of a fluid, and a rear peripheral portion of the conical shape in the radial direction becomes an outlet of the fluid. Although an inclined surface of a peripheral side in the conical shape of the rotary hub is illustrated as a curve surface having a predetermined curvature, the present inventive concept is not limited thereto.

The blades 12 are radially disposed on the inclined surface of the rotary hub 11 while being spaced apart from each other by a predetermined interval. The blades 12 may have a three-dimensional curved shape by taking specifications of a compressor, such as application purpose, compression capacity and flow velocity, into consideration. The blades 12 may be integrally formed with the rotary hub 11. It is also possible to bond the blade to the rotary hub 11 through a welding scheme after processing the blade by using a material the same as that of the rotary hub 11.

Further, a blade bonded onto the inclined surface of the rotary hub 11 by a bonding scheme may not provide desired strength for high speed rotation. However, as will be described later, since strength can be reinforced through an integral shroud including a bonding shroud and a shroud blade, the impeller may have the condition applicable for the high-rotation compressor.

The bonding shrouds 100 are formed at top ends of the blades 12 in the longitudinal direction of the blades 12. The bonding shrouds 100 may be formed by the same material as that of the blades 12. As shown in the drawing, the bonding shrouds 100 may be horizontally formed on the blades 12 in perpendicular to the blades 12 and may be easily bonded to the shroud blade 200.

In addition, after a plurality of blades are prepared by mechanical processing, casting, or HIP scheme, the bonding shrouds 100 may be integrally formed with the top ends of the blades 12 by mechanical processing.

In addition, although not shown in the drawing, the bonding shrouds 100 may be separately prepared as necessary through mechanical processing, casting, or HIP scheme, and then bonded to the top ends of the blades 12 through a typical bonding scheme such as welding or brazing.

In this case, until the bonding shrouds 100 are formed at the top ends of the blades 12, it may be configured as a typical open impeller, so that the mechanical processing is simply achieved without complexity and inconvenience, and it is possible to achieve high processing yield rate, superior structural stability, and high size precision.

That is, since an opening is formed between the blades 12 and the bonding shrouds 100, mechanical processing for the impeller is simply and easily achieved as in the open impeller.

The shroud blades 200 are bonded between the boding shrouds 100 by a typical bonding scheme such as welding or brazing, and finally forms an integral shroud 13 in corporation with the bonding shrouds 100. In this case, the shroud blade 200 may be formed by the same material as that of blades 12 or the bonding shrouds 100 so that bonding efficiency can be improved.

Further, the shroud blade is manufactured by mechanical processing, casting, or HIP scheme, and then processed by mechanic processing generally known in the art.

In addition, the bonding shrouds 100 and the shroud blades 200 may be bonded to each other through a bonding part provided on contact surfaces of the bonding shrouds 100 and the shroud blades 200 using a bonding scheme such as a typical welding or brazing to prevent the shroud blades 200 from being separated by a centrifugal load and gas pressure That is, as shown in the drawing, the contact surfaces are formed as a vertical surface 302 so that both sides of the bonding shrouds 100 are bonded to both sides of the shroud blades 200 through a bonding scheme such as typical welding or brazing.

Figure 6:
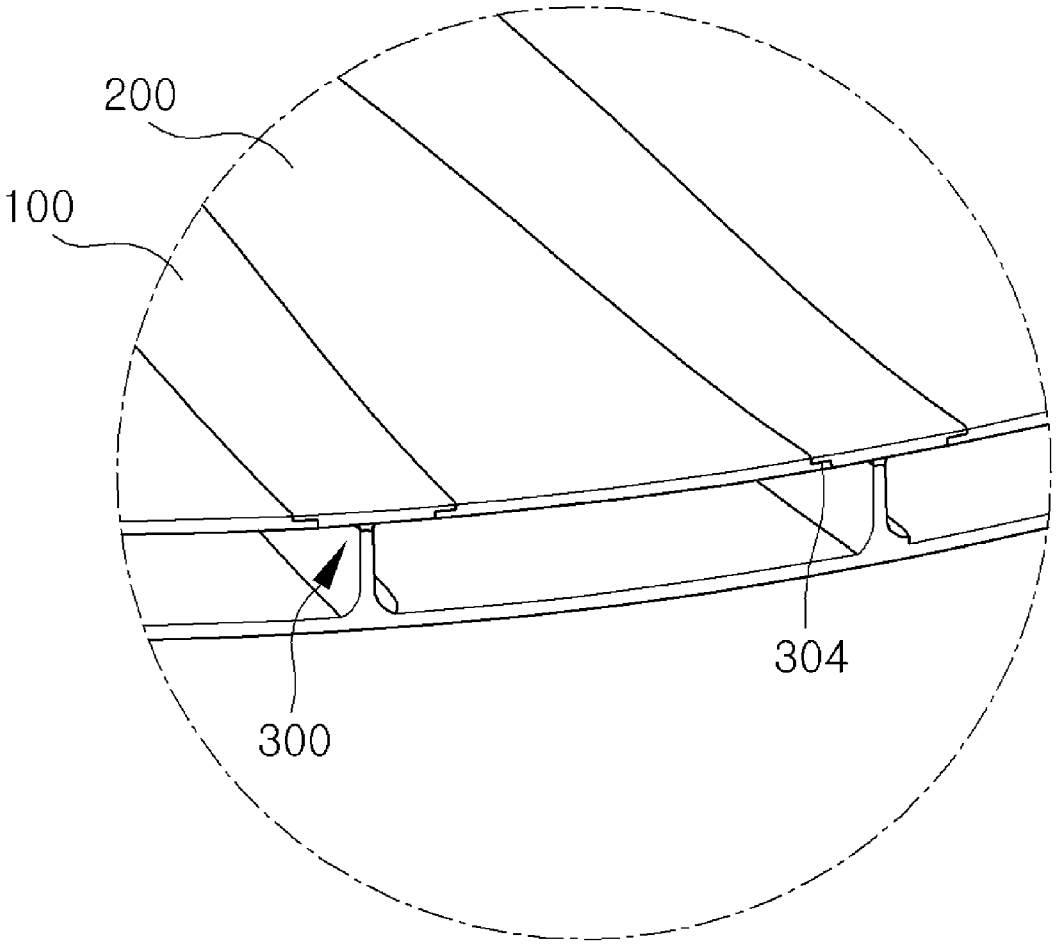
FIG. 6 is an enlarged view of a portion shown in FIG. 5 according to a second exemplary embodiment of the present inventive concept.

FIG. 6 is a partially enlarged view illustrating a second example of the shroud impeller of a centrifugal compressor shown in FIG. 5. The bonding part 300 may be prepared in the form of stepped surfaces 304 corresponding to each other, that is, a typical stepped form. That is, the bonding part 30 may has the widest bonding area to represent high bonding force.

Further, the stepped surface 304 of the shroud blade 200 is placed lower than the stepped surface 304 of the bonding shroud 100. That is, as a centrifugal load and gas pressure due to rotation are applied from an inner direction to an outer direction of the shroud blade, the stepped surface 304 of the shroud blade 200 may be prevented from being separated from the bonding shroud.

Figure 7:
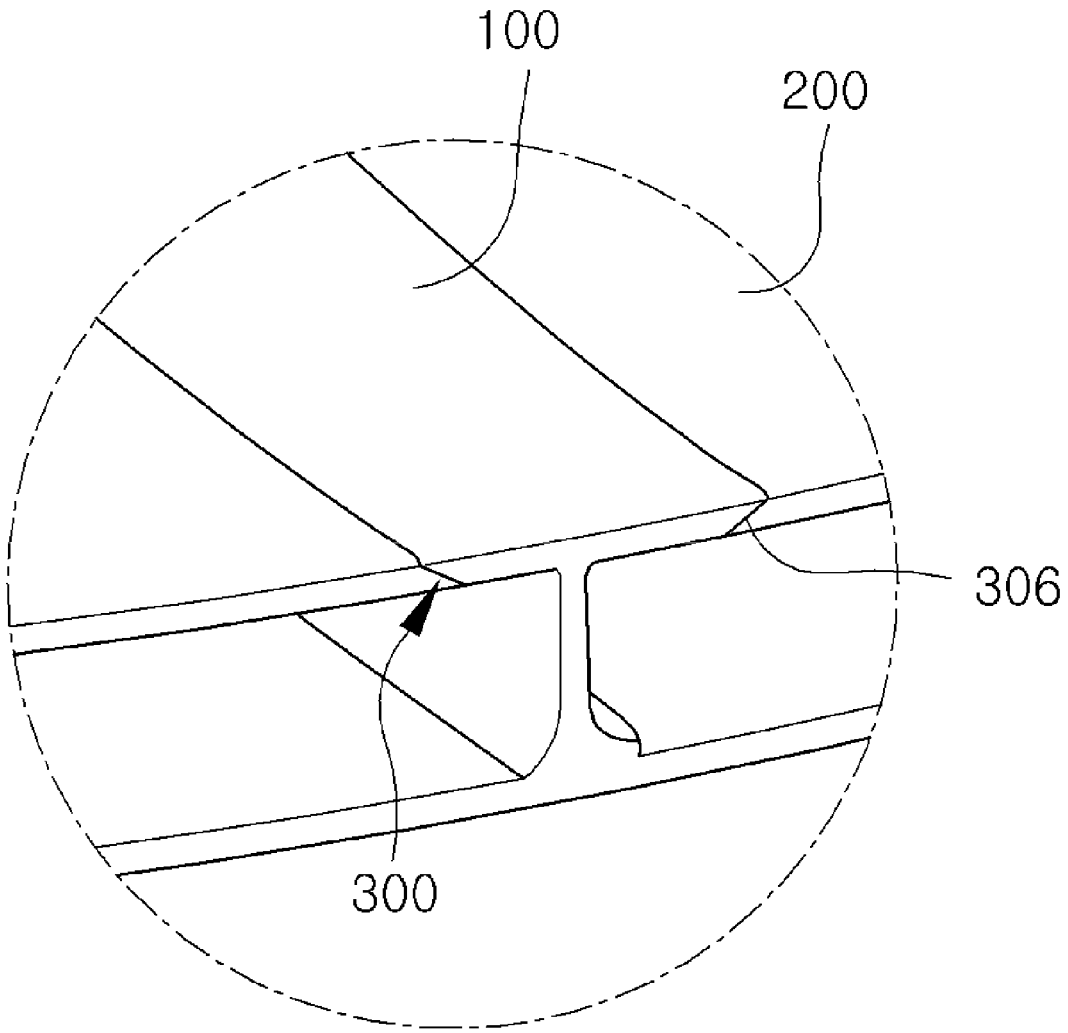
FIG. 7 is an enlarged view of a portion shown in FIG. 5 according to a third exemplary embodiment of the present inventive concept.

FIG. 7 is a partially enlarged view illustrating a third example of the shroud impeller of a centrifugal compressor shown in FIG. 5. The bonding part 300 is prepared in the form of inclined surfaces 306 which are formed corresponding to each other. The inclined surfaces 306 may have a bonding area wider than that of a vertical surface so that high bonding force may be achieved In addition, the inclined surfaces 306 may be inclined toward the blades 200 from both ends of the bonding shroud 100. Further, as the centrifugal load and the gas pressure due to the rotation is applied from the inner direction to the outer direction of the shroud blade, the stepped surface 306 may prevent the shroud blade from being separated from the bonding shroud.

Figure 8:
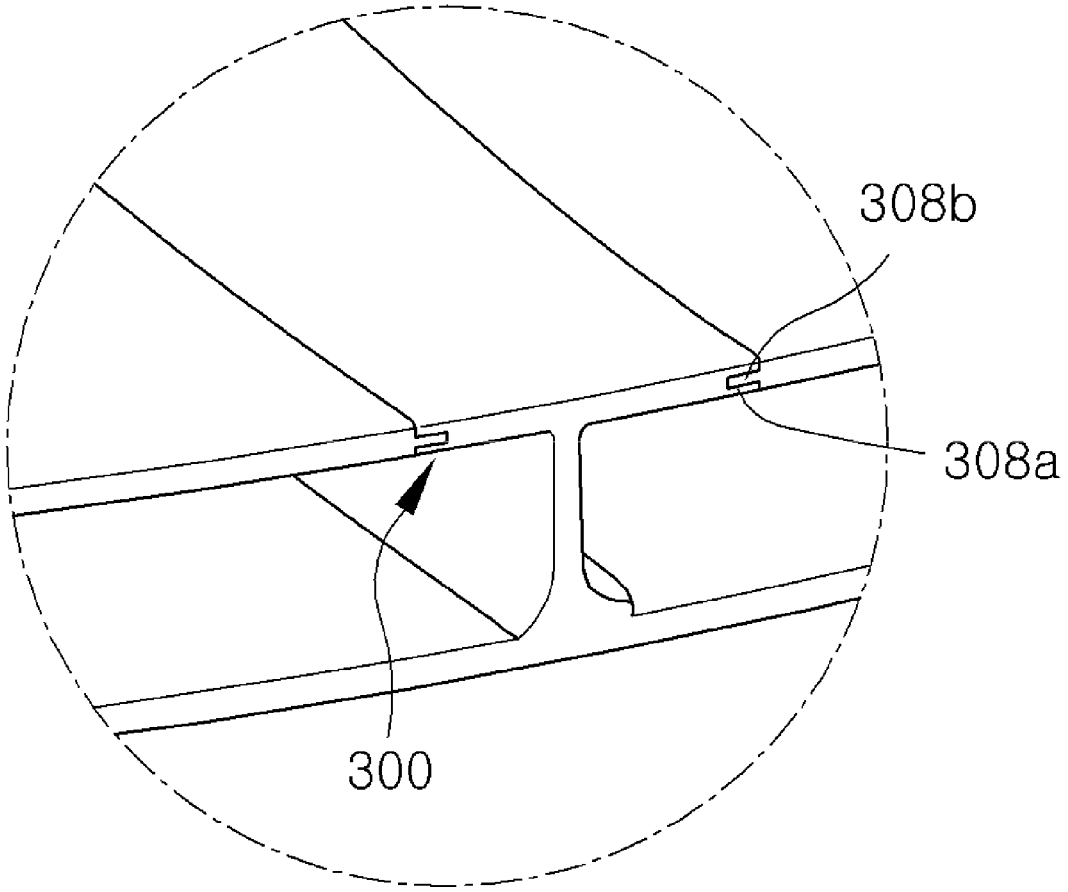
FIG. 8 is an enlarged view of a portion shown in FIG. 5 according to a fourth exemplary embodiment of the present inventive concept.

FIG. 8 is a partially enlarged view illustrating a fourth example of the shroud impeller of a centrifugal compressor shown in FIG. 5. The bonding part 300 includes a coupling groove 308*a* formed at one of contact surfaces of the bonding shrouds 100 and the shroud blades 200 and a coupling protrusion 308*b* formed at a remaining one of the contact surfaces corresponding to the coupling groove and the bonding part 300 is welded after the coupling protrusion 308*b* is fitted into the coupling groove 308*a*.

That is, the coupling groove and the coupling protrusion corresponding to each other are formed at the bonding shroud or the shroud blade. The coupling groove is slidably coupled with the coupling protrusion, and the coupled part is bonded by a bonding scheme such as typical welding or brazing so that the bonding shroud may be integrally formed with the shroud blade.

Since the bonding scheme between the coupling groove and the coupling protrusion may have higher strength than that of the second and third embodiments, even if the centrifugal load and the gas pressure due to the rotation are applied from the inner direction to the outer direction of the shroud blade, the bonding scheme between the coupling groove and the coupling protrusion may have a condition capable of preventing the shroud blade from being separated from the bonding shroud.

Further, as a space between bonding shrouds coupled with the shroud blade has a width gradually widened from a rotor hub side to an outer end side of a blade, the coupling groove may be easily and slidably coupled with the coupling protrusion.

Figure 9:
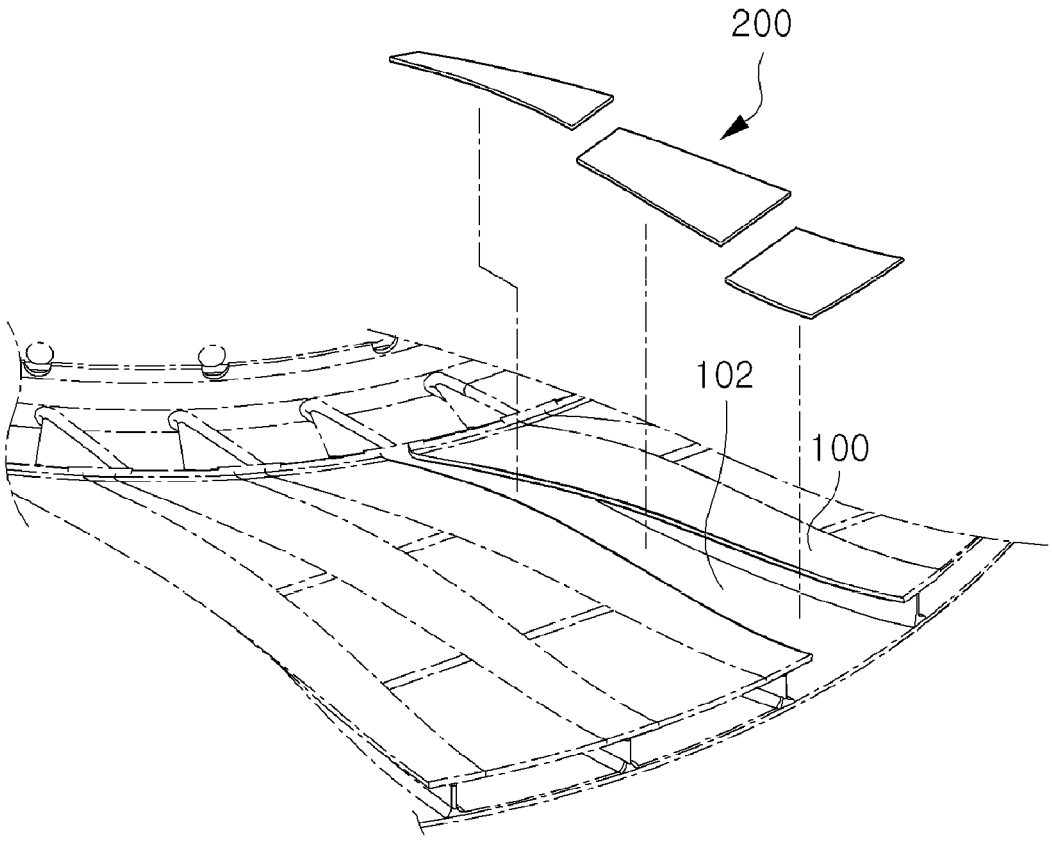
FIG. 9 is a partially exploded perspective view illustrating a fifth exemplary embodiment of the present inventive concept.

FIG. 9 is a partially exploded perspective view illustrating a fifth exemplary embodiment of the present inventive concept. In order to increase workability, precision, handling convenience, and weldability as compared with a case of forming one shroud blade 200 between the bonding shrouds 100, the shroud blade 200 may be divided into a plurality of pieces bonded to each other by a general bonding scheme such as typical welding or brazing.

That is, as compared with a case where one shroud blade bonded between the bonding shrouds is prepared as one piece, workability and precision can be improved when the shroud blade 200 is divided into a plurality of pieces.

In addition, since the shroud blade is divided into a plurality of pieces, a worker may conveniently handle the shroud blade in transportation, storage and bonding work.

Figure 10:
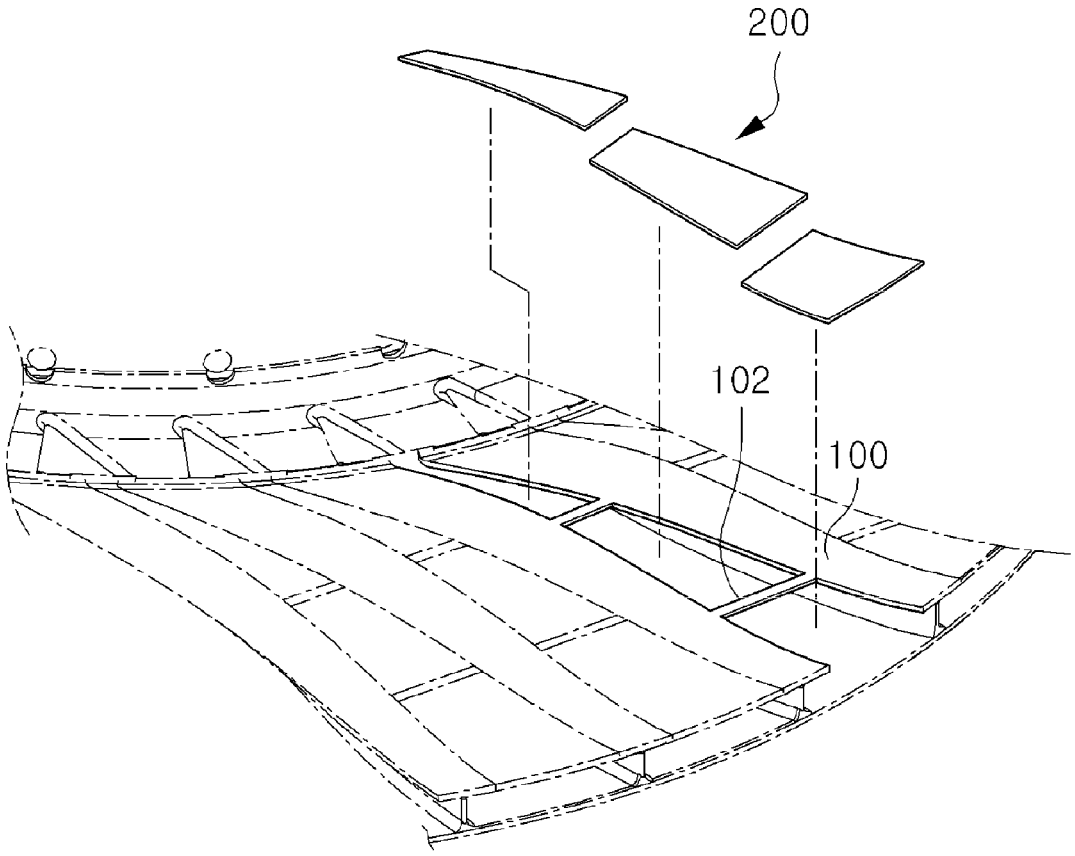
FIG. 10 is a partially exploded perspective view illustrating a sixth exemplary embodiment of the present inventive concept.

FIG. 10 is a partially exploded perspective view illustrating a sixth exemplary embodiment of the present inventive concept. One or a plurality of connection ribs 102 are connected between the bonding shrouds 100. The shroud blades are divided to have shapes corresponding to a region between each connection rib 102 and the bonding shroud 100 and are bonded to each other by a bonding scheme such as typical welding or brazing. The connection rib 102 may be integral with the bonding shroud 100. In addition, the connection rib 102 may be separately prepared and bonded between the bonding shrouds 100 through a typical bonding scheme such as welding or brazing upon formation of the bonding shroud 100.

Accordingly, the shroud blade divided into several pieces are bonded at four points of the bonding shroud and the connection rib provided at both sides of the shroud blade, that is, the edges of the shroud blade are bonded, so that higher bonding force may be ensured. Accordingly, the shroud blades can be prevented from being separated due to high speed rotation and high gas pressure.

Further, since the shroud blades are divided into several pieces, as described above, the shroud blades have a condition capable of improving workability, precision, handling convenience, and weldability as compared with a case where the shroud blade is prepared as a single member.

Figure 11:
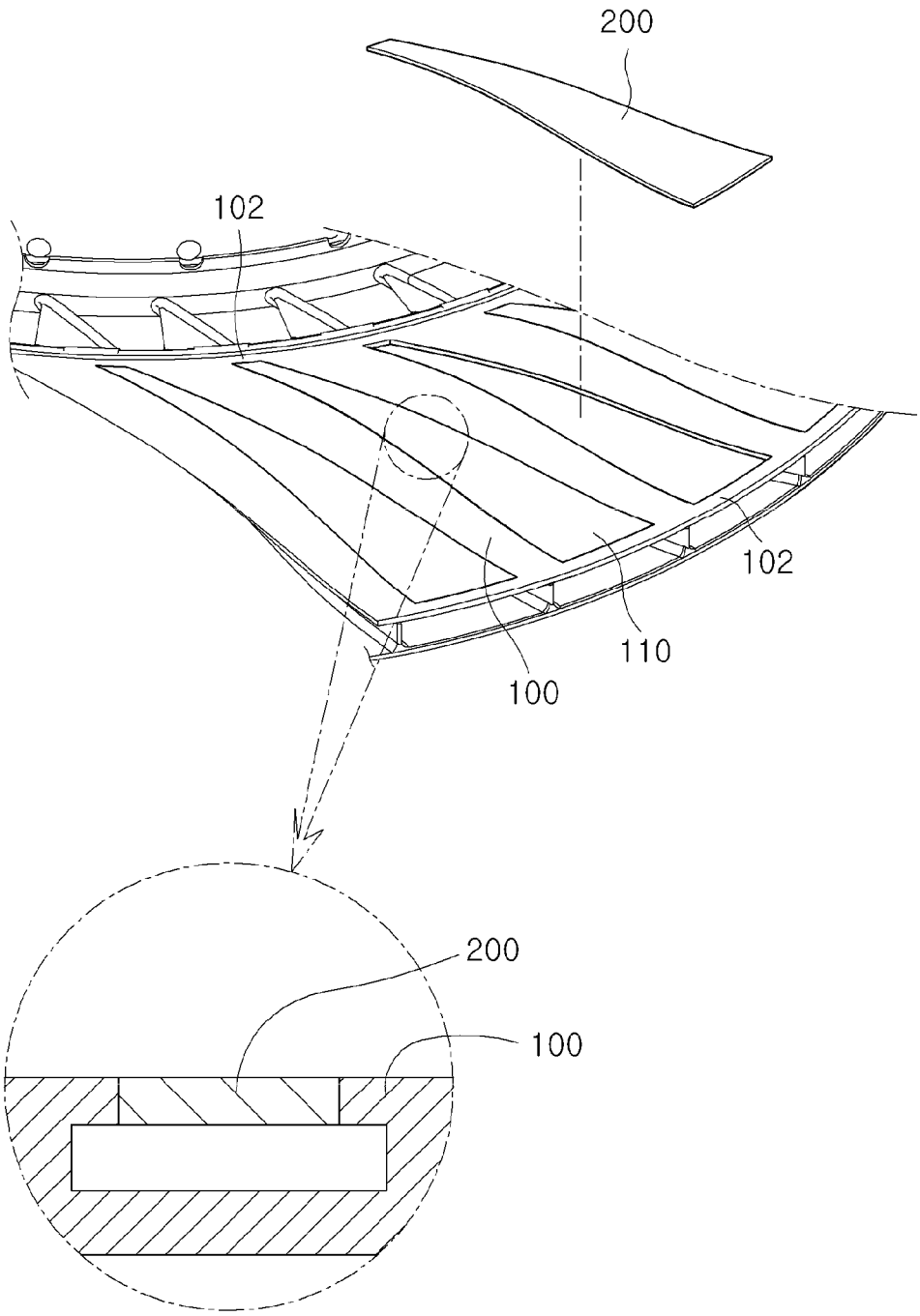
FIG. 11 is a partially exploded perspective view illustrating a seventh exemplary embodiment of the present inventive concept.

FIG. 11 is a partially exploded perspective view illustrating a seventh exemplary embodiment of the present inventive concept. As shown in FIG. 11, a bonding space part 110 having a pocket shape is formed between an inner end and an outer end of the bonding shroud 100 by the connection rib 102. The shroud blade 200 is formed corresponding to the bonding space part 110 and is bonded by a bonding scheme such as typical welding or brazing. In this case, the shroud blade 200 may be inserted from an upper portion or a lower portion of the bonding space part 110 so as to be bonded. If the shroud blade 200 is inserted from the lower portion of the bonding space part 110, the shroud blade 200 can be prevented from being separated from the bonding shroud and the connection rib even if the centrifugal load and the gas pressure are applied from an inner direction to an outer direction of the shroud blade,.

Accordingly, the present inventive concept has high structural stability by the shroud blade inserted into the bonding space part. That is, as inner ends and outer ends of the shroud blade are fixedly bonded by the bonding shroud and the connection rib provided at both sides of the shroud blade, the shroud blade has high structural stability and high strength so that the present inventive concept has a condition suitable for high speed rotation and high pressure.

Figure 12:
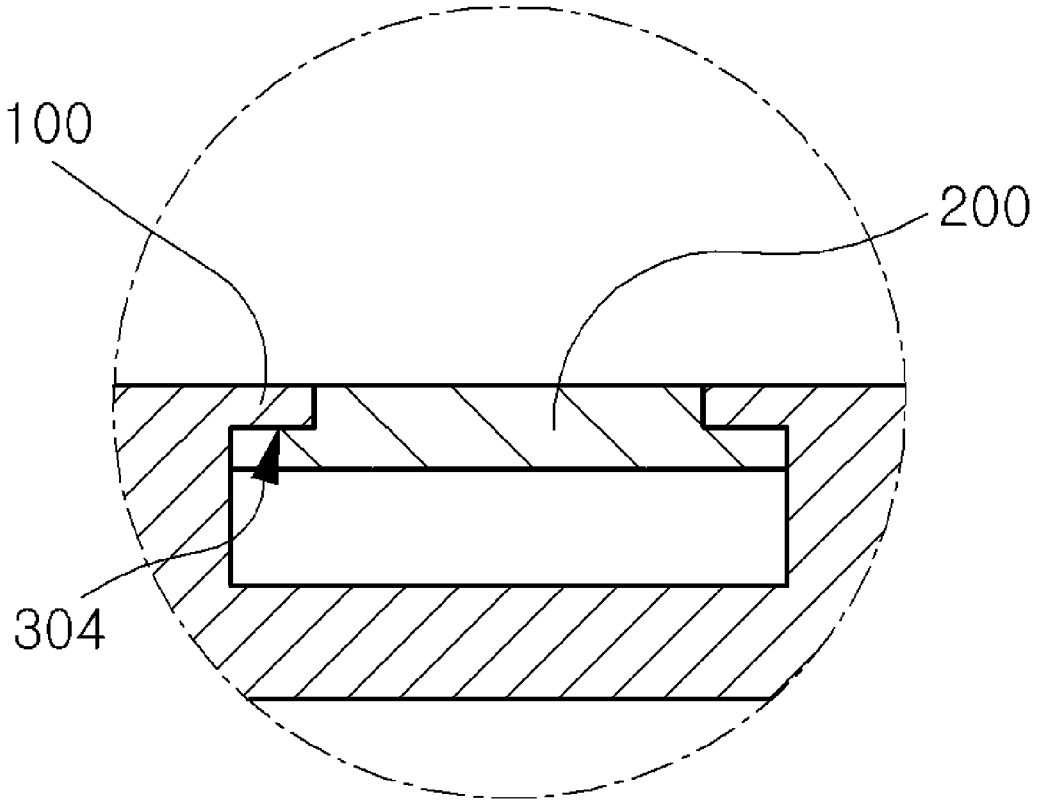
FIG. 12 is a partially sectional view illustrating another exemplary embodiment of FIG. 11.

Further, as shown in FIG. 12, the shroud blade 200 is bonded with the bonding shroud 100 and the connection rib by stepped surfaces 304 having a stepped shape through a bonding scheme such as typical welding or brazing. In this case, similar to the second embodiment of FIG. 6, the stepped surface 304 of the shroud blade 200 may be placed below the bonding shroud 100.

Accordingly, as described above, the bonding area may be enlarged so that the bonding force is increased. As a centrifugal load and gas pressure due to rotation are applied from an inner direction to an outer direction of the shroud blade, the bonded shroud blade may be prevented from being separated from the bonding shroud.

Figure 13:
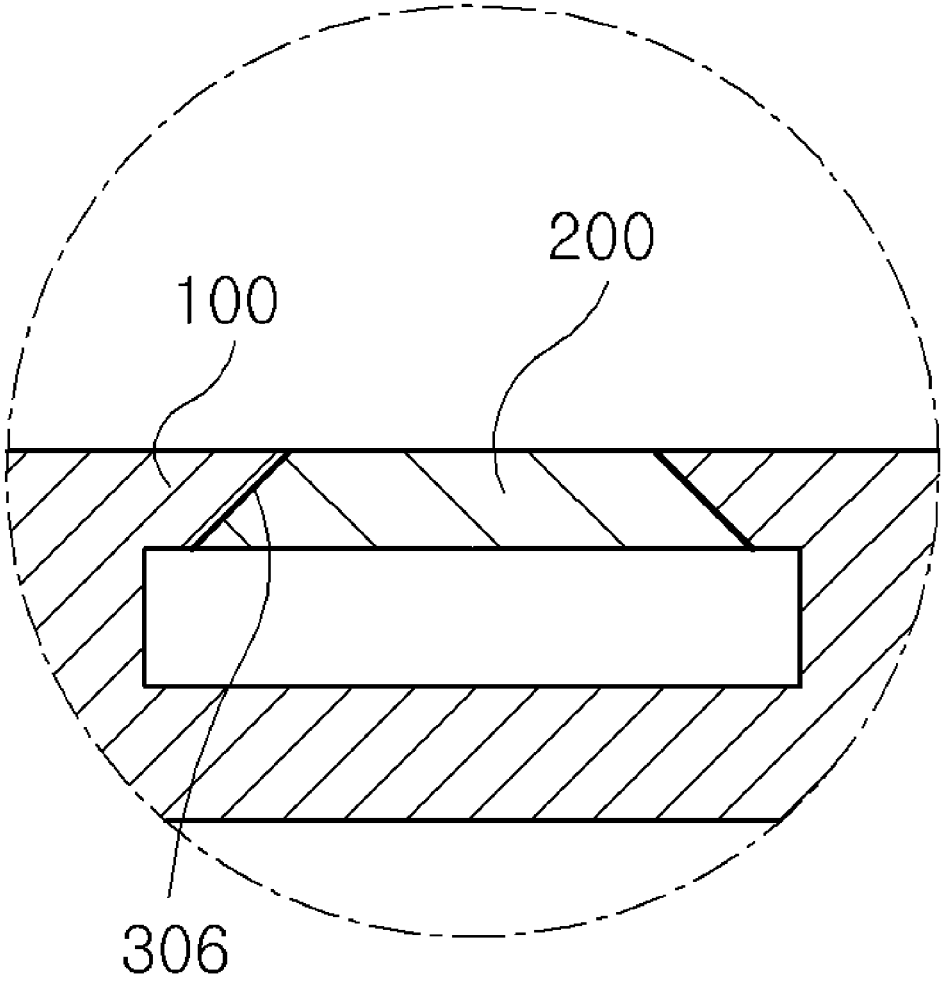
FIG. 13 is a partially sectional view illustrating still another exemplary embodiment of FIG. 11.

Further, similar to the third embodiment of FIG. 7, the bonding shroud 100 is bonded with the connection rib and the shroud blade 200 by inclined surfaces 306 of FIG. 13. The stepped surface 304 has the same condition as that of the stepped surface described above, so the detailed description thereof will be omitted.

Figure 14:
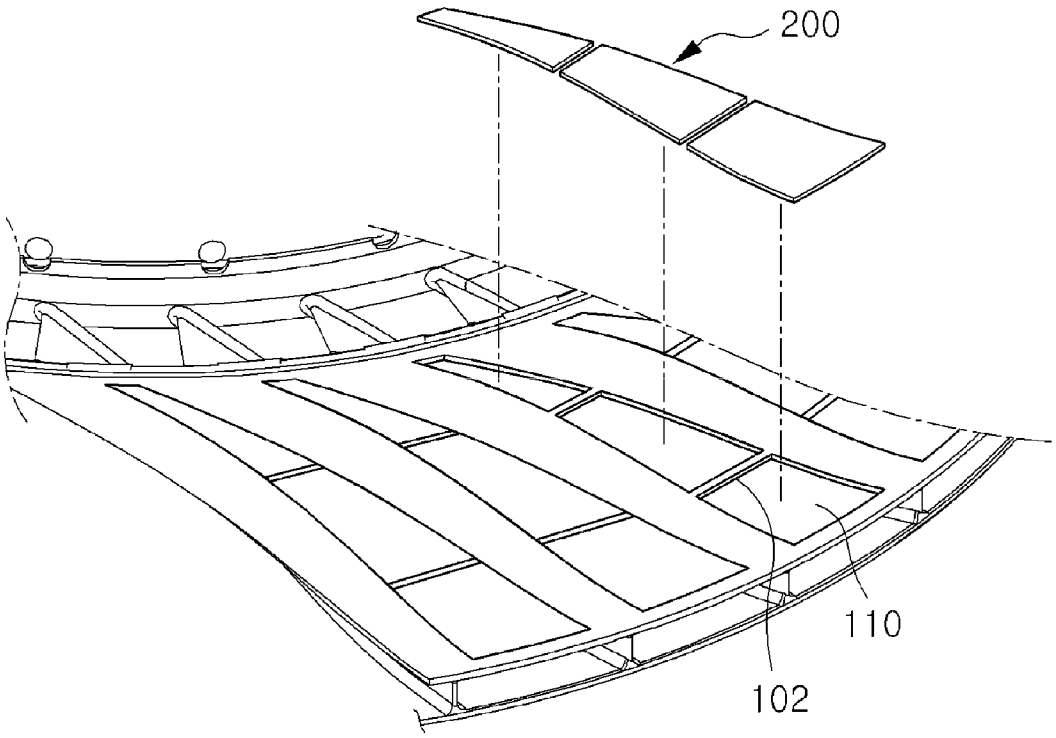
FIG. 14 is a partially exploded view illustrating still another exemplary embodiment of FIG. 11.

Meanwhile, as shown in FIG. 14, one or a plurality of connection ribs 102 are formed in the boding space part 110 as described in the sixth embodiment of FIG. 10. Further, the shroud blade 200 has a shape corresponding to the bonding space part 110 between the connection ribs 102 and is bonded by a bonding scheme such as typical welding or brazing. In this case, the connection rib 102 formed in the bonding space part 110 may be integrally formed with the bonding shroud 100 when the bonding shroud 100 is formed. In addition, the connection rib 102 may be separately prepared and bonded between the bonding shrouds 100 and be bonded through a typical bonding scheme such as welding or brazing upon formation of the bonding shroud 100.

Accordingly, bonding shrouds divided into several pieces may be bonded at four points of the bonding shroud and the connection rib provided at both sides of the shroud blade. That is, the edges of the shroud blade are bonded so that higher bonding force may be ensured. Accordingly, the shroud blades can be prevented from being separated due to high speed rotation and high gas pressure.

Further, since the shroud blades are divided into several pieces, as described above, the shroud blades have a condition capable of improving workability, precision, handling convenience, and weldability as compared with a case where the shroud blade is prepared as a single member.

Figure 15:
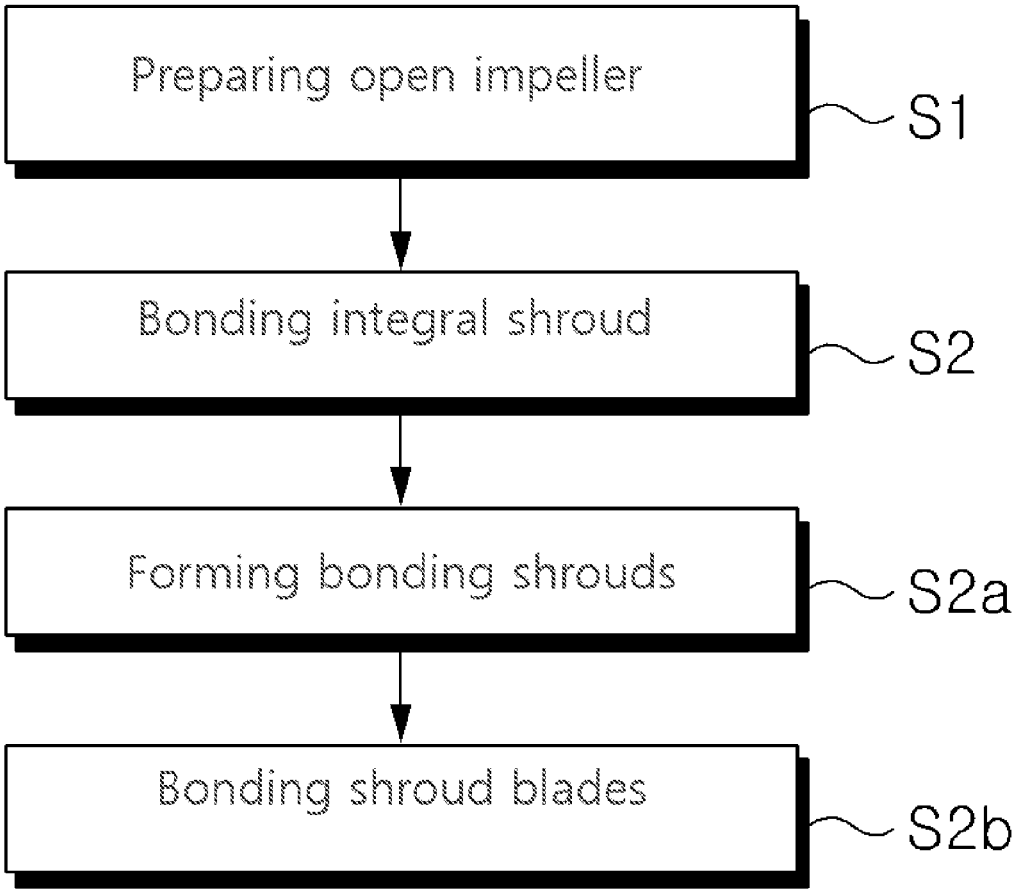
FIG. 15 is a block diagram illustrating a method of manufacturing the shroud impeller according to the present inventive concept.

FIG. 15 is a block diagram illustrating a method of manufacturing the shroud impeller of a centrifugal compressor according to the exemplary embodiment of the present inventive concept.

As shown in the drawing, the method of manufacturing the shroud impeller of the centrifugal compressor according to the exemplary embodiment of the present inventive concept includes the operation of preparing a rotary hub connected to a driving shaft connected to a power source so as to be rotated, and a plurality of blades radially provided about a rotational axis of the rotary hub by mechanical processing, casting, or HIP scheme, and preparing a typical open impeller by the mechanical processing (S1).

In addition, the method includes the operation of forming an integral shroud onto top ends of the blades by a bonding scheme such as typical welding or brazing so that flow loss a fluid to be compressed is reduced (S2). In this case, the integral shroud is bonded in a direction from the rotary hub to outer ends of the blades.

The bonding of the integral shroud (S2) includes horizontally forming a plurality of bonding shrouds bonded onto the top ends of the blades in perpendicular to the blades (operation S2*a*), and bonding a plurality of shroud blades 200 between the bonding shrouds 100, respectively, such that the shroud blades 200 have shapes corresponding to a space between the bonding shrouds 100, by mechanical processing the bonding shrouds 100 by a general bonding scheme such as welding or brazing after the shroud blades are prepared by the mechanical processing, casting, or HIP scheme (operation S2*b*).

When the blades are formed, the bonding shroud can be integrally formed with the blades. In addition, the bonding shroud having the material the same as that of blades may be separately processed and bonded on top ends of the blades by a typical bonding scheme such as welding or brazing.

The shroud blades are bonded to the bonding shroud by a bonding part which is processed on contact surfaces of the shroud blades and the bonding shroud to prevent the shroud blades from being separated caused by a centrifugal load and gas pressure. As described above, the bonding part may be prepared in various forms, such as the stepped surface, the inclined surface and the combination of the coupling groove and the coupling protrusion to the extent that the bonding part is not separated after the bonding.

In addition, the shroud blade may be divided into one or a plurality of pieces bonded to each other. As described above, the shroud blade may be divided into several pieces so as to be bonded between connection ribs which are formed between the bonding shrouds. The advantages achieved through the division of the shroud blade have been described above.

Therefore, according to the method of manufacturing the shroud impeller of the present inventive concept, mechanical processing can be simply achieved, which is the advantage of the typical open impeller, and the processing yield rate, structural stability, and size precision can be improved.

What is claimed is:

1. A shroud impeller of a centrifugal compressor, the shroud impeller comprising:

a rotary hub connected to a driving shaft;

a plurality of blades radially provided about a rotational axis of the rotary hub; and an integral shroud bonded onto top ends of the plurality of blades, wherein the integral shroud is bonded onto the top ends of the plurality of blades in a direction from the rotary hub to outer ends of the plurality of blades, wherein the integral shroud comprises:

a plurality of bonding shrouds formed on the top ends of the plurality of blades, respectively; and a plurality of shroud blades bonded between the bonding shrouds, respectively, and wherein each of the plurality of shroud blades is divided into a plurality of pieces bonded to each other.

2. The shroud impeller of claim 1, wherein the bonding shrouds are integrally formed with the top ends of the plurality of blades.

3. The shroud impeller of claim 1, wherein the bonding shrouds are separately prepared and bonded to the top ends of the plurality of blades.

4. The shroud impeller of claim 1, wherein the bonding shrouds and the shroud blades are bonded to each other through a bonding part provided on contact surfaces of the bonding shrouds and the shroud blades to prevent the shroud blades from being separated by a centrifugal load and gas pressure.

5. The shroud impeller of claim 4, wherein the bonding part is prepared in a form of stepped surfaces which are formed corresponding to each other.

6. The shroud impeller of claim 5, wherein a stepped surface of the shroud blade is placed lower than the stepped surface of the bonding shroud.

7. The shroud impeller of claim 4, wherein the bonding part is prepared in a form of inclined surfaces which are formed corresponding to each other.

8. The shroud impeller of claim 7, wherein the inclined surfaces are inclined toward the plurality of blades from both ends of the bonding shroud.

9. The shroud impeller of claim 4, wherein the bonding part comprises a coupling groove formed at one of the contact surfaces of the bonding shrouds and the shroud blades and a coupling protrusion formed at a remaining one of the contact surfaces corresponding to the coupling groove and the bonding part is welded after the coupling protrusion is fitted into the coupling groove.

10. A shroud impeller of a centrifugal compressor, the shroud impeller comprising:

a rotary hub connected to a driving shaft;

a plurality of blades radially provided about a rotational axis of the rotary hub; and an integral shroud bonded onto top ends of the plurality of blades, wherein the integral shroud is bonded onto the top ends of the plurality of blades in a direction from the rotary hub to outer ends of the plurality of blades, wherein the integral shroud comprises:

a plurality of bonding shrouds formed on the top ends of the plurality of blades, respectively; and a plurality of shroud blades bonded between the bonding shrouds, respectively, and wherein one or a plurality of connection ribs are connected between the bonding shrouds, and the shroud blades are divided to have shapes corresponding to a region between each connection rib and the bonding shroud and are bonded to each other.

11. The shroud impeller of claim 10, wherein the bonding shroud, the connection rib, and the shroud blade are bonded to each other by stepped surfaces.

12. The shroud impeller of claim 10, wherein the bonding shroud, the connection rib, and the shroud blade are bonded to each other by inclined surfaces.

13. A shroud impeller of a centrifugal compressor, the shroud impeller comprising:

a rotary hub connected to a driving shaft;

a plurality of blades radially provided about a rotational axis of the rotary hub; and an integral shroud bonded onto top ends of the plurality of blades, wherein the integral shroud is bonded onto the top ends of the plurality of blades in a direction from the rotary hub to outer ends of the plurality of blades, wherein the integral shroud comprises:

a plurality of bonding shrouds formed on the top ends of the plurality of blades, respectively; and a plurality of shroud blades bonded between the bonding shrouds, respectively, and wherein a bonding space part is formed between an inner end and an outer end of the bonding shroud by a connection rib, and the shroud blade is formed corresponding to the bonding space part and is bonded.

14. The shroud impeller of claim 13, wherein the bonding shroud, the connection rib, and the shroud blade are bonded to each other by stepped surfaces.

15. The shroud impeller of claim 13, wherein the bonding shroud, the connection rib, and the shroud blade are bonded to each other by inclined surfaces.

16. The shroud impeller of claim 13, wherein a plurality of connection ribs are formed in the boding space part, and the shroud blade is inserted to have a shape corresponding to the bonding space part between the plurality of connection ribs.

* * * * *